US009249590B2

(12) United States Patent
Bloink et al.

(10) Patent No.: US 9,249,590 B2
(45) Date of Patent: Feb. 2, 2016

(54) FLUID FLOW DEFLECTOR ASSEMBLIES PRINCIPALLY FOR CONNECTION TO SWEEP TAIL HOSES OF AUTOMATIC SWIMMING POOL CLEANERS

(75) Inventors: Tommy Bloink, San Marcos, CA (US); Gerhardus J. Stoltz, Temecula, CA (US)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 629 days.

(21) Appl. No.: 13/080,801

(22) Filed: Apr. 6, 2011

(65) Prior Publication Data

US 2012/0255579 A1 Oct. 11, 2012

(51) Int. Cl.
*E04H 4/16* (2006.01)

(52) U.S. Cl.
CPC ..... *E04H 4/1654* (2013.01); *E04H 4/1681* (2013.01)

(58) Field of Classification Search
USPC ..... 134/166 R, 167 R, 168 R, 168 C, 167 C, 134/169 R, 169 C, 166 C, 172, 173, 176
See application file for complete search history.

(56) References Cited

U.S. PATENT DOCUMENTS

| | | | | |
|---|---|---|---|---|
| 2,515,600 | A * | 7/1950 | Hayes | 239/428.5 |
| 2,569,683 | A * | 10/1951 | Lindsay | 239/428.5 |
| 2,766,026 | A * | 10/1956 | Boyd | 261/76 |
| 3,776,464 | A | 12/1973 | Proffit | |
| 4,356,582 | A * | 11/1982 | Stephenson | 15/1.7 |
| 4,834,423 | A | 5/1989 | Deland | |
| 5,238,585 | A | 8/1993 | Reed, Sr. | |
| 5,931,510 | A | 8/1999 | Mathew et al. | |
| 5,992,451 | A | 11/1999 | Chang | |
| 5,996,906 | A | 12/1999 | Cooper | |
| 6,199,916 | B1 | 3/2001 | Klinger et al. | |
| 7,478,840 | B2 * | 1/2009 | Youssefifar | 285/319 |
| D602,128 | S | 10/2009 | Williams et al. | |
| D615,165 | S | 5/2010 | Mcalpine et al. | |
| D639,398 | S | 6/2011 | Wilhelm | |
| D642,244 | S | 7/2011 | Wilhelm | |
| D654,988 | S | 2/2012 | Bloink et al. | |
| D654,989 | S | 2/2012 | Bloink et al. | |
| D657,027 | S | 4/2012 | Bloink et al. | |
| 2008/0073911 | A1 | 3/2008 | Wells et al. | |
| 2010/0011521 | A1 | 1/2010 | Collins | |

OTHER PUBLICATIONS

International Search Report and Written Opinion dated Jun. 5, 2012 in related Application No. PCT/US2012/024040.
International Preliminary Report on Patentability dated Oct. 17, 2013 in related Application No. PCT/US2012/024040.

* cited by examiner

*Primary Examiner* — David Cormier
(74) *Attorney, Agent, or Firm* — Kilpatrick Townsend & Stockton LLP; Dean W. Russell

(57) ABSTRACT

Detailed are fluid flow deflectors principally for use with sweep tail hoses of automatic swimming pool cleaners. The deflectors do not function principally on gravitational forces and need not necessarily employ flexible components or attachments for purposes of effecting deflection. Instead, the deflectors may be rigid and continually position a fixed obstacle in a central portion of a fluid stream. Perforations in a rigid wall, moreover, draw fluid into the deflectors, creating a greater volume of exiting stream when an associated pool cleaner is underwater.

3 Claims, 4 Drawing Sheets

FLUID FLOW DEFLECTOR ASSEMBLIES PRINCIPALLY FOR CONNECTION TO SWEEP TAIL HOSES OF AUTOMATIC SWIMMING POOL CLEANERS

FIELD OF THE INVENTION

This invention relates to diverters of flowing fluid and more particularly, although not exclusively, to rigid assemblies configured to entrain ambient fluid into a fluid jet and to divert fluid without need for flexible components or attachments.

BACKGROUND OF THE INVENTION

U.S. Patent Application Publication No. 2010/0011521 of Collins discloses an example of a deflector of water exiting a sweep tail hose of an automatic swimming pool cleaner. The deflector is "a relatively flexible structure in comparison with the sweep tail hose," see Collins, p. 1, ¶ 0008, and includes a mounting collar and multiple "elongated and highly flexible fingers projecting in a downstream direction." See id., p. 3, ¶ 0029 (numerals omitted). As noted in the Collins application:

> During normal submerged operation as the pool cleaner and sweep tail hose travel over submerged pool floor and side wall surfaces, water jetted from the sweep tail hose flows substantially without restriction through the deflector. However, when the discharge end of the sweep tail hose breaks the surface of water within the swimming pool, the relatively flexible deflector falls by gravity over the otherwise open discharge end of the sweep tail hose to deflect water jetted therefrom. Accordingly, the deflector effectively knocks down and prevents water jetted from the sweep tail hose from spraying over any significant distance or area of a surrounding pool deck region.

See id., p. 1, ¶ 0008.

Described in U.S. Pat. No. 5,996,906 to Cooper is another deflector likewise designed to exploit principles of gravity. Detailed as being a "hole filled cover," see Cooper, Abstract, 1.3, the flexible device of the Cooper patent moves, under force of gravity, to intercept a flowing water stream when a sweep tail hose exits a pool. Preferred devices are tubular bags of flexible woven metal material that supposedly allow water to pass through unaffected when the sweep tail is underwater. See id., col. 4, 11.31-45.

Water exits sweep tail hoses of at least some automatic swimming pool cleaners under significant pressure. Indeed, such pressure often may be sufficient to separate the flexible fingers of the deflector of the Collins application when the hoses break the surfaces of pool water. If this separation occurs, no deflection of flow will occur thereafter, and the stream of exiting water will continue unabated. Additionally, the tubular bags of the Cooper patent likely produce back pressure when the sweep tail hoses are underwater, reducing the effectiveness of the hoses and the associated cleaners. Accordingly, need exists for deflectors that function satisfactorily when sweep tail hoses are both underneath and above pool water surfaces.

SUMMARY OF THE INVENTION

The present invention provides such deflectors as alternatives to those of the Collins application and the Cooper patent. The deflectors do not operate principally based on gravitational forces. Consequently, they need not necessarily employ flexible components or attachments such as the fingers of the Collins application or the hole-filled bags of the Cooper patent.

Instead, rigid deflectors of the present invention continually position a fixed obstacle in a central portion of a fluid stream. Perforations in a rigid wall, moreover, draw fluid into the deflectors, creating a greater volume of exiting stream when an associated pool cleaner is underwater. This greater volume substantially offsets the power lost by the underwater stream contacting the fixed obstacle, avoiding much of the underwater performance degradation otherwise occurring through addition of a deflector. Hence, pool cleaners and their sweep tail hoses continue to operate well underwater notwithstanding attachment of deflectors of the present invention.

It thus is an optional, non-exclusive object of the present invention to provide deflectors of flowing fluid.

It is another optional, non-exclusive object of the present invention to provide fluid flow deflectors for use with sweep tail hoses of automatic swimming pool cleaners.

It is also an optional, non-exclusive object of the present invention to provide fluid flow deflectors omitting functional flexible components or attachments.

It is a further optional, non-exclusive object of the present invention to provide fluid flow deflectors not predominantly dependent on gravitational forces to divert flowing fluid.

It is, moreover, an optional, non-exclusive object of the present invention to provide rigid deflectors with centrally-positioned, fixed obstacles at which flowing fluid is directed.

It is an additional optional, non-exclusive object of the present invention to provide fluid flow deflectors entraining ambient pool water into an exiting stream when the deflectors are underwater.

Other objects, features, and advantages will be apparent to those skilled in appropriate fields with reference to the remaining text and the drawings of this application.

DETAILED DESCRIPTION

Figure 1:
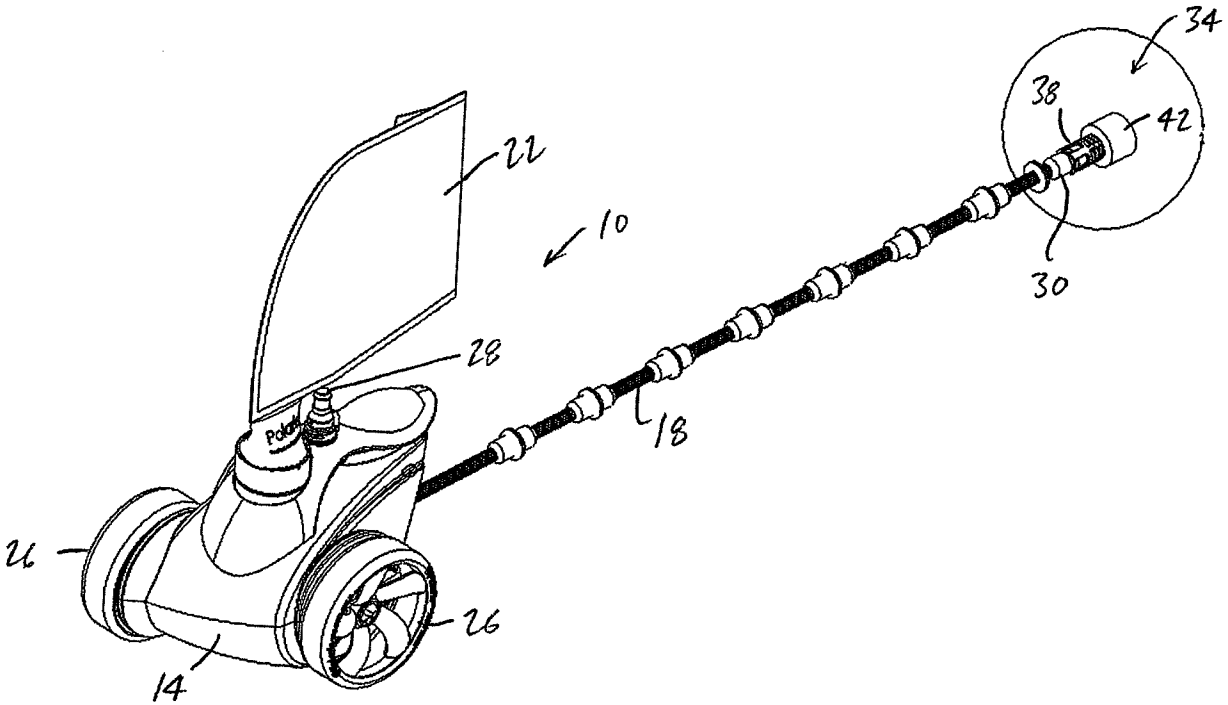
FIG. 1 is a perspective view of an automatic swimming pool cleaner utilizing an exemplary deflector assembly consistent with the present invention.
Figure 2:
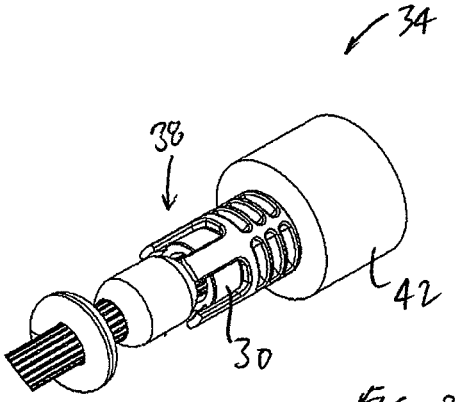
FIG. 2 is a close-up view of the deflector assembly shown as encircled in FIG. 1.
Figure 3:
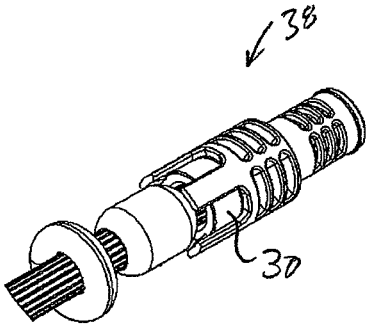
FIG. 3 is another close-up view of the deflector assembly of FIGS. 1-2 shown with an optional scrubber removed.
Figure 4:
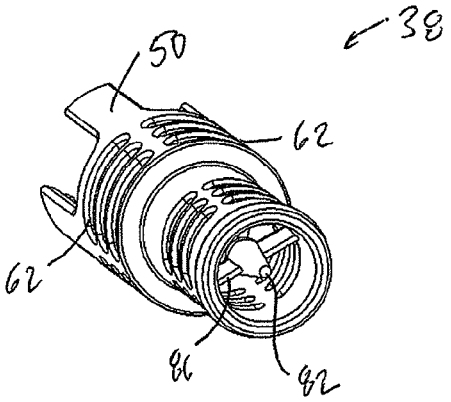
FIGS. 4-5 are perspective views of the deflector assembly depicted in FIG. 3.

Illustrated in FIG. 1 is an exemplary automatic swimming pool cleaner 10 for use in connection with the present invention. Cleaner 10 may include body 14, sweep tail hose 18 and, if desired, a debris filter such as bag 22 and a motive mechanism such as wheels 26. Cleaner 10 preferably is a "pressure-side" cleaner, to which pressurized water exiting a pump is routed. The pressurized water may travel through a hose (not shown) to entrance 28 of body 14. Thereafter, some of the pressurized water may be used to create a low pressure region (via the Venturi effect) drawing debris-laden pool water into the body 14 through an inlet (not shown) and thence into bag 22. By contrast, some of the pressurized water exits body 14 into and through sweep tail hose 18, causing the sweep tail hose 18 to sweep along a pool surface and disturb debris into suspension in the pool water.

Optimal underwater performance of sweep tail hose 18 occurs when the pressurized water travels through it generally unobstructed. Hence, any fluid obstruction attached to exit 30 of sweep tail hose 18 will degrade performance of the hose 18 underwater. Conversely, any obstruction attached to exit 30 conceivably could "improve" performance of sweep tail hose 18 above the waterline, at least in the sense of inhibiting water jetted from the hose 18 from spraying over any significant distance or area of a surrounding pool deck region, as noted in the Collins application.

Deflector assembly 34 (FIGS. 1-7) seeks to inhibit spray from hose 18 above the waterline yet reduce, if not minimize, degradation in its performance underwater. Assembly 34 may include deflector 38 together with optional scrubber 42. Persons skilled in the art will recognize that other components may be included as part of assembly 34 if necessary or desired.

The illustrated version of deflector 38 shows it as generally cylindrical in shape, albeit with differing cross-sectional diameters along portions of its length. This represents a presently-preferred configuration of deflector 38, although other shapes may be permissible. Likewise, although as illustrated deflector 38 is molded of plastic material as an integral unit, it may be constructed or assembled differently than shown or formed of different material.

Figure 5:
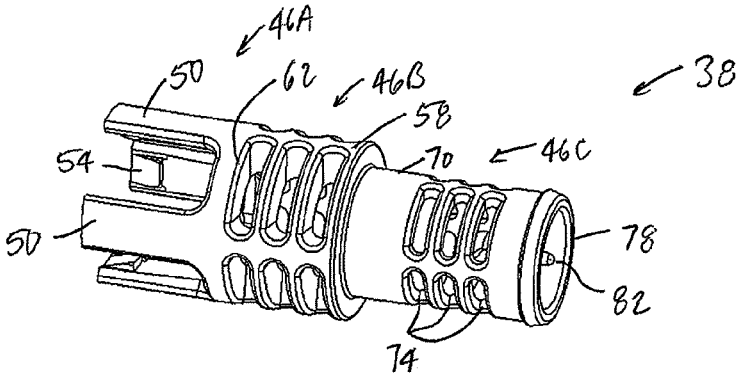
Figure 6:
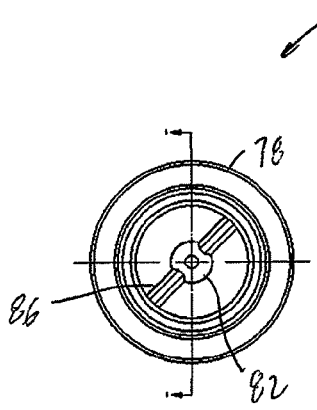
FIG. 6 is an end view of the deflector assembly depicted in FIG. 3.
Figure 7:
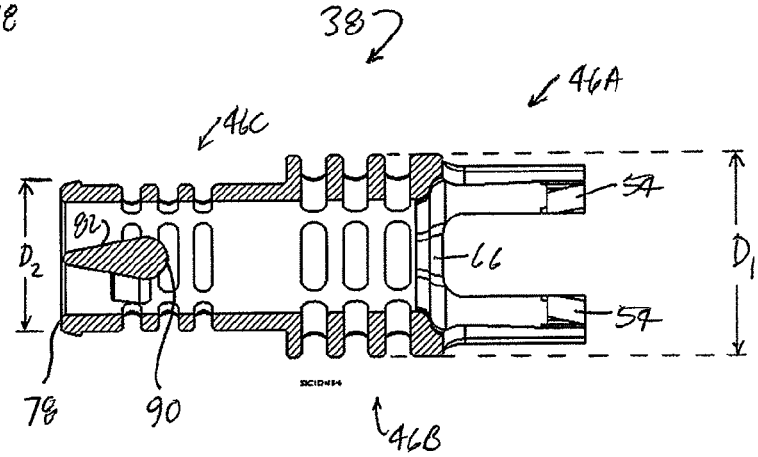
FIG. 7 is a cross-sectional view of the deflector assembly depicted in FIG. 3.

Defined by deflector 38 may be first, second, and third sections 46A-C, respectively. First section 46A preferably is a fitting allowing attachment of deflector 38 to exit 30. To facilitate attachment, first section 46A may comprise multiple circumferential flanges 50, four of which are shown in FIG. 5. Each flange 50 advantageously may flex outward at least slightly and terminate in a ramp 54, facilitating snap-fitting deflector 38 onto exit 30. Numerous other means for attaching deflector 38 to sweep tail hose 18 may be employed instead, of course, as recognized by those skilled in the field.

Second section 46B forms an entrainment region of deflector 38. It comprises generally cylindrical wall 58 of diameter $D_1$ in which one or more openings 62 is present. Nine such openings 62 (arranged in three sets of three rows) are illustrated in FIG. 5, although more or fewer openings 62 may exist instead. As depicted, each opening 62 may comprise an elongated, oval aperture or slot, although this particular shape—while advantageous—is not critical to the invention.

Whereas pressurized fluid from exit 30 enters deflector 38 through first section 46A (and flows from left to right in FIG. 5), openings 62 function principally as entrances for ambient fluid into the deflector 38. Indeed, flow of the pressurized fluid through inlet or restriction 66 of size less than $D_1$ creates below-ambient pressure regions adjacent openings 62, drawing ambient fluid into second section 46B. When deflector 38 is underwater, the ambient fluid is water, which is entrained with the pressurized fluid to create a larger volume of water travelling through third section 46C and thereafter exiting deflector 38. Air, by contrast, will be entrained when deflector 38 is above the water surface.

Third section 46C may comprise generally cylindrical wall 70 of diameter $D_2$. Diameter $D_2$ preferably is less than diameter $D_1$, as no further fluid entrainment is necessarily needed. Instead, openings 74 of wall 70, together with exit end 78, function principally as exits for fluid travelling within deflector 58. Although openings 74—like openings 62—are depicted as sets of elongated ovals, other shapes, sets, and arrangements may be employed instead.

Diametrically centrally located in third section 46C adjacent end 78 is obstruction 82. Obstruction 82 preferably is fixed in this position as, for example, by rigid beams 86 molded with or otherwise connected to wall 70. As shown especially in FIG. 7, obstruction 82 may extend longitudinally from end 78 into third section 46C, with its contact surface 90 generally longitudinally aligned with at least some openings 74. Presently-preferred is that contact surface 90 be rounded or curved, so that obstruction 82 resembles a teardrop. Contact surface 90 need not necessarily be rounded, however, nor must obstruction 82 resemble a teardrop.

Some fluid travelling through third section 46C will exit deflector 38 via end 78. Other fluid travelling through third section 46C is directed toward and thus will encounter contact surface 90 of obstruction 82. Such contact deflects fluid (radially outward) toward openings 74, with the deflected fluid interacting with other flowing fluid as it moves laterally toward and out of openings 74. Thus resulting is, generally, a laterally-oriented spray of fluid out of openings 74 and a longitudinally-oriented stream of fluid out of end 78.

When deflector 38 is underwater, water spray from openings 74 and concurrent diminution of velocity of the stream exiting end 78 tend to diminish the sweeping action of sweep tail hose 18, hence tending to degrade its performance. However, the entrained water entering via openings 62 creates a larger volume of flowing water than otherwise would be present, helping to offset the power lost by the underwater stream contacting obstruction 82.

When deflector 38 is above water, diminishment of the stream velocity exiting end 78 is beneficial, as it reduces the distance the stream may travel over the surrounding pool deck. Combined with the fact that much of the spray out of openings 74 is likely to return to the pool, the stream diminishment decreases both the quantity and forcefulness with which water will exit a pool. Accordingly, deflector 38 solves the problems identified in the Collins application and Cooper patent while maintaining useful functioning of sweep tail hose 18 underwater.

Such is true as well for alternate deflector 138 of the present invention. Deflector 138 may be similar to deflector 38 in many respects and comprise, for example, first, second, and third sections 146A-C, respectively. First section 146A, like corresponding first section 46A, preferably is a fitting permitting deflector 138 to be attached to exit 30. It thus may, if desired, include circumferential flanges 150 terminating in ramps 154 to facilitate snap-fitting deflector 138 onto exit 30.

Figure 8:
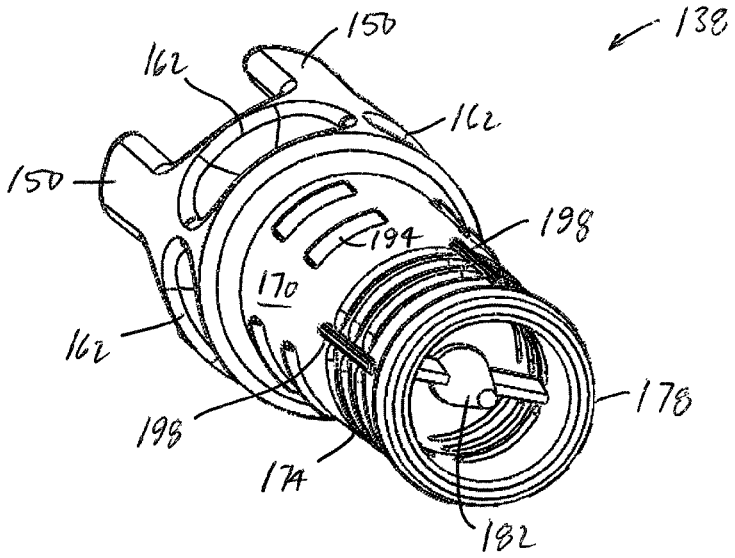
FIGS. 8-9 are perspective views of an alternate deflector assembly of the present invention.
Figure 9:
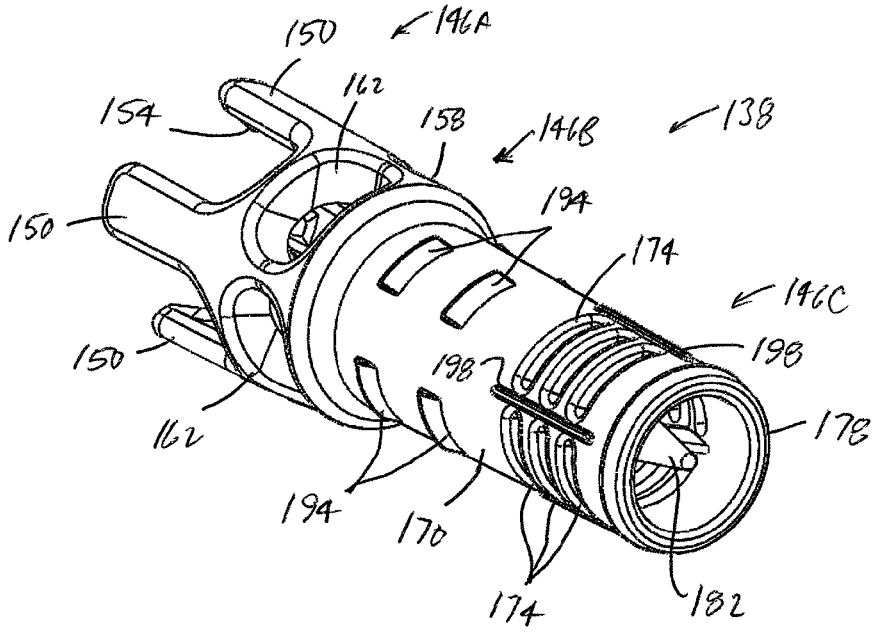

Entrainment of ambient fluid likewise may occur via second section 146B. This second section 146B may comprise generally cylindrical wall 158 in which openings 162 are present. Unlike the nine openings 62 depicted in FIG. 5, however, only three openings 162 are shown in FIGS. 8-9. Spaced about the circumference of wall 158, openings 162 provide less obstruction to entering fluid than does openings 62, allowing entrainment of additional ambient fluid when needed.

Third section 146C may comprise generally cylindrical wall 170, preferably (although not necessarily) of diameter less than the diameter of wall 158. Openings 174 may be similar to openings 74 of deflector 38, and end 178 and obstacle 182 may be similar to respective end 78 and obstacle 82. Wall 170 may, however, optionally include additional structure to reduce the possibility of any attached scrubber 42 being detached from deflector 138 in use. The structure may include "grippers" in the forms of either or both of laterally-oriented, circumferentially-spaced protrusions 194 and longitudinally-oriented, circumferentially-spaced ribs 198. In addition to inhibiting rotation of scrubber 42 about wall 170, ribs 198 also may function to strength the wall 170. Other gripping and strengthening means may be included as well if desired.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the terms "pool" and "pools" as referenced herein need not be limited to swimming pools, but rather may include spas, hot tubs, and other bodies of water or fluid. Finally, contents of the Collins application and Cooper patent are incorporated herein in their entireties by this reference.

What is claimed is:

1. A deflector of pressurized fluid, comprising:

a. an inlet for receiving pressurized fluid;

b. a cylindrical wall (i) having a circumference and a cross-sectional diameter $D_1$ and (ii) comprising means for receiving ambient fluid for entrainment with the pressurized fluid;

c. a section which (i) is generally cylindrical, (ii) has cross-sectional diameter $D_2$, where $D_2$ is less than $D_1$, and (iii) defines (A) an exit end comprising (1) a fluid exit, (2) a wall, and (3) a slotted opening through the wall and (B) a path for flow of pressurized fluid to the fluid exit;

d. an obstacle to at least some flow of pressurized fluid positioned in the section, the obstacle having a length and being (i) inflexible, (ii) of non-uniform diameter along its length so as to have teardrop shape, and (iii) configured so that at least some of the pressurized fluid encountering it is deflected substantially normal to the path toward the slotted opening;

e. a plurality of flexible flanges depending from, and spaced about, the circumference of the cylindrical wall, each flexible flange (i) adapted to flex outward and (ii) terminating in a ramp for attachment to a sweep tail hose of an automatic pool cleaner; and f. beams (i) molded with or connected to the wall and (ii) fixing a position of the obstacle in the section.

2. A method of cleaning a swimming pool comprising:

a. providing an automatic swimming pool cleaner comprising (i) a body, (ii) a sweep tail hose connected to the body, and (iii) a motive mechanism for autonomously moving the body within a swimming pool;

b. connecting a deflector assembly to the sweep tail hose, the deflector assembly comprising (i) an inlet for receiving pressurized fluid exiting the sweep tail hose, (ii) a first opening for receiving ambient fluid for entrainment with the pressurized fluid, (iii) a section defining an exit end comprising (A) a fluid exit, (B) a wall, and (C) a second opening through the wall, and (iv) an obstacle to at least some flow of pressurized fluid positioned in the section, the obstacle configured so that at least some of the pressurized fluid encountering it is deflected toward the second opening; and c. operating the automatic swimming pool cleaner, thereby causing (i) ambient fluid to be received by the first opening and entrained with the pressurized fluid, (ii) some of the pressurized fluid to exit the deflector assembly via the fluid exit, (iii) some of the pressurized fluid to encounter the obstacle and deflect toward the second opening, and (iv) the motive mechanism to move the body within the swimming pool.

3. A method according to claim 2 in which the ambient fluid received by the first opening and entrained with the pressurized fluid is (a) water when the deflector assembly is below the water surface of the swimming pool and (b) air when the deflector assembly is above the water surface of the swimming pool.

* * * * *